United States Patent [19]

Kazaoka et al.

[11] Patent Number: 5,074,769

[45] Date of Patent: Dec. 24, 1991

[54] COMPRESSOR HAVING AN ORBITAL ROTOR WITH PARALLEL LINKAGE AND SPRING BIASED VANES

[75] Inventors: Kenichi Kazaoka, Nagoya; Hiroshi Okazaki, Kariya, both of Japan

[73] Assignee: Aisin Seiki Kabushiki Kaisha, Kariya, Japan

[21] Appl. No.: 627,764

[22] Filed: Dec. 14, 1990

Related U.S. Application Data

[63] Continuation of Ser. No. 411,308, Sep. 22, 1989, abandoned.

[30] Foreign Application Priority Data

Sep. 22, 1988 [JP] Japan ..... 63-238376

[51] Int. Cl.[5] ..... F04C 18/344

[52] U.S. Cl. ..... 418/61.1; 418/266

[58] Field of Search ..... 418/61.1, 266; 417/284

[56] References Cited

U.S. PATENT DOCUMENTS

| | | | |
|---|---|---|---|
| 2,423,507 | 7/1947 | Lawton | 418/61.1 |
| 2,732,126 | 1/1956 | Smith | 418/61.1 |
| 3,620,654 | 11/1971 | Allen | 418/266 |
| 4,086,039 | 4/1978 | Ettridge | 418/61.1 |
| 4,253,806 | 3/1981 | D'Amato | 418/61.1 |
| 4,692,104 | 9/1987 | Hanson | 418/61.1 |

FOREIGN PATENT DOCUMENTS

| | | | |
|---|---|---|---|
| 1403296 | 3/1969 | Fed. Rep. of Germany | 418/266 |
| 18492 | 1/1982 | Japan | 418/61.1 |
| 61-57578 | 3/1986 | Japan . | |
| 62-51787 | 3/1987 | Japan . | |

*Primary Examiner*—Richard A. Bertsch
*Assistant Examiner*—David L. Cavanaugh
*Attorney, Agent, or Firm*—Burns, Doane, Swecker & Mathis

[57] ABSTRACT

A rotary compressor includes a support member for supporting a revolution piston while preventing rotary movement thereof with respect to its axis, and at least two sliding blades provided in the revolution piston. Both blades are biased against a surrounding cylinder by a one-piece spring. The maximum volume of the chamber is larger than the conventional chamber due to reciprocal movement of the slidable blades. The blades are positioned or rest at almost the same position in the radial direction of the revolution piston. Therefore, any inertia which effects the spring due to the sliding blades is very small. Thus, the sliding blades press the cylinder with almost constant force which is predetermined by the spring, even if the revolution piston changes the rotational speed thereof.

8 Claims, 9 Drawing Sheets

COMPRESSOR HAVING AN ORBITAL ROTOR WITH PARALLEL LINKAGE AND SPRING BIASED VANES

This application is a Continuation of application Ser. No. 07/411,308, filed Sept. 22, 1989, now abandoned.

BACKGROUND OF THE INVENTION

1. Field of the Invention

This invention relates to a rotary compressor which is utilized for use in an air conditioner.

2. Description of the Related Art

FIG. 13 shows a conventional rotary compressor. A cylindrical revolution piston 101 is eccentrically connected to a crank shaft 102. The revolution piston 101 revolves around the crank-shaft 102 while maintaining continuous contact with a cylinder 103. At this time, the revolution piston 101 also turns or rotates on its axis. A sliding blade 104 is provided in the cylinder 103. The sliding blade 104 is inserted in a slit 105 which is provided radially in the cylinder 103. The sliding blade 104 is urged toward the revolution piston 101 by a spring 106.

A space in the cylinder 103 is divided into two chambers. One of the chambers is inlet chamber 107 and the other is a discharge chamber 108. A suction port 109 is opened to the inlet chamber 107. Further, a discharge port 110 is opened to the discharge chamber 108. A discharge valve 111 is provided on the discharge port 110 in order to prevent the working medium from reversing.

While the revolution piston 101 rotates in the counterclockwise direction, the working medium is drawn into the inlet chamber 107 through the suction port 109 due to the volume of the inlet chamber 107 being expanded. At the same time, the working medium is discharged from the discharge chamber 109 to the discharge port 110 as the volume of the discharge chamber 108 is contracted. The working media opens the discharge valve 111 due to its pressure and is discharged from the compressor.

Such conventional compressor is disclosed in Japanese laid-open patent publication No. 62-51787 published on Mar. 6, 1987. Further, Japanese patent publication No. 61-57578 published on Dec. 6, 1986 discloses another conventional compressor having two sliding blades.

However, the conventional compressors have the following drawbacks:

(a) Dimensions of the compressor are large compared to the internal volume of the cylinder 103 because the sliding blade 104 which is provided in the cylinder 103 requires a dead space; and (b) Working medium may be leaked through the sliding blade 104 due to inertia which causes the sliding blade 104 to pull apart or separate from the revolution piston 101.

SUMMARY OF THE INVENTION

Accordingly, one of the objects of this invention is to obviate the above conventional drawbacks.

It is also an object of this invention to minimize dimensions of a compressor.

Further, it is an object of this invention to prevent a leakage of working medium through a sliding blade.

To achieve the above objects, and in accordance with the principles of the invention as embodied and broadly described herein, the rotary compressor comprises support means for supporting a revolution piston which does not turn round on its axis, and at least two sliding blades provided on the revolution piston. Preferably, the support means includes a parallel linkage.

BRIEF DESCRIPTION OF THE DRAWINGS

The accompanying drawings, which are incorporated in and constitute a part of the specification illustrates an embodiment of the invention, and together with the description, serve to explain the principles of the invention.

DETAILED DESCRIPTION OF THE PREFERRED EMBODIMENTS

Reference will now be made in detail to the present preferred embodiment of the inventor, an example of which is illustrated in the accompanying drawings. In accordance with the invention, a rotary compressor comprises support element 27, 28 for supporting a revolution piston 26 so that it will not turn round on its axis, and at least two sliding blades 31, 32 provided in the revolution piston 26.

Figure 1:
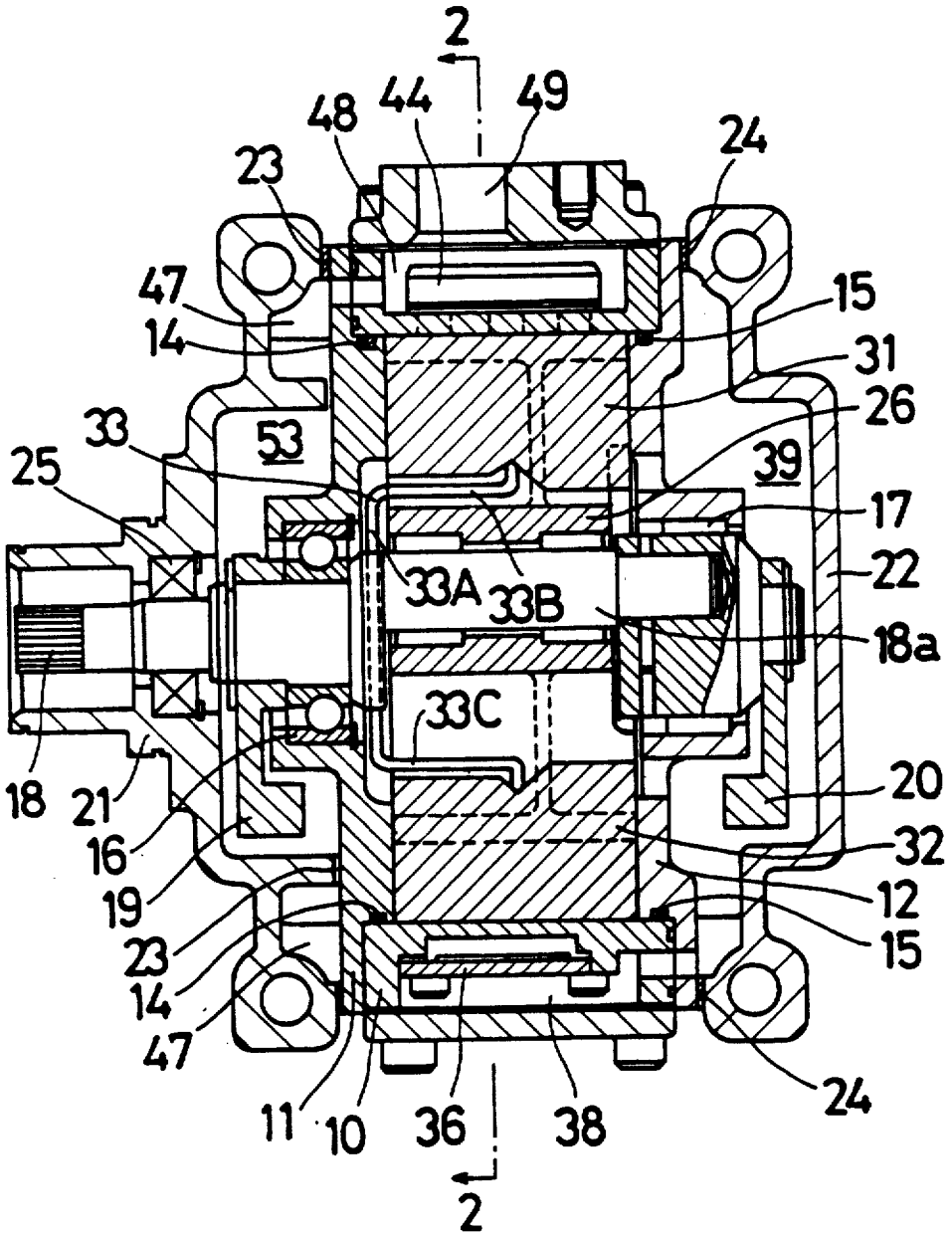
FIG. 1 is a vertical cross-sectional view of a rotary compressor taking along line 1—1 in FIG. 2.

Referring now to FIG. 1, the rotary compressor of the first embodiment is explained. A front end plate 11 and a rear end plate 12 are joined to both ends of a cylinder 10 by four bolts. An O-ring seal 14 is inserted between the front end plate 11 and the cylinder 10. Further, another O-ring seal 15 is inserted between the rear end plate 12 and cylinder 10. These O-rings 14, 15 keep the cylinder 10 air tight.

A pair of bearings 16, 17 are fixed to the front end and the rear end plates 11, 12. These bearings 16, 17 rotatably support a crank shaft 18. A pair of balance weights 19, 20 are connected to the crank shaft 18. The balance weights 19, 20 are enclosed by front cover 21 and the rear cover 22.

A gasket 23 is provided between the front end plate 11 and the front cover 21. Further, a seal member 25 is provided between the crank shaft 18 and the front cover 21. The gasket 23 and the seal member 25 keep the front cover 21 air tight. A space 53 in the front cover 21 is connected to a suction inlet passage 39 through gaps of the bearings 16, 17. The suction inlet passage 39 will be explained with reference to FIG. 2.

Figure 2:
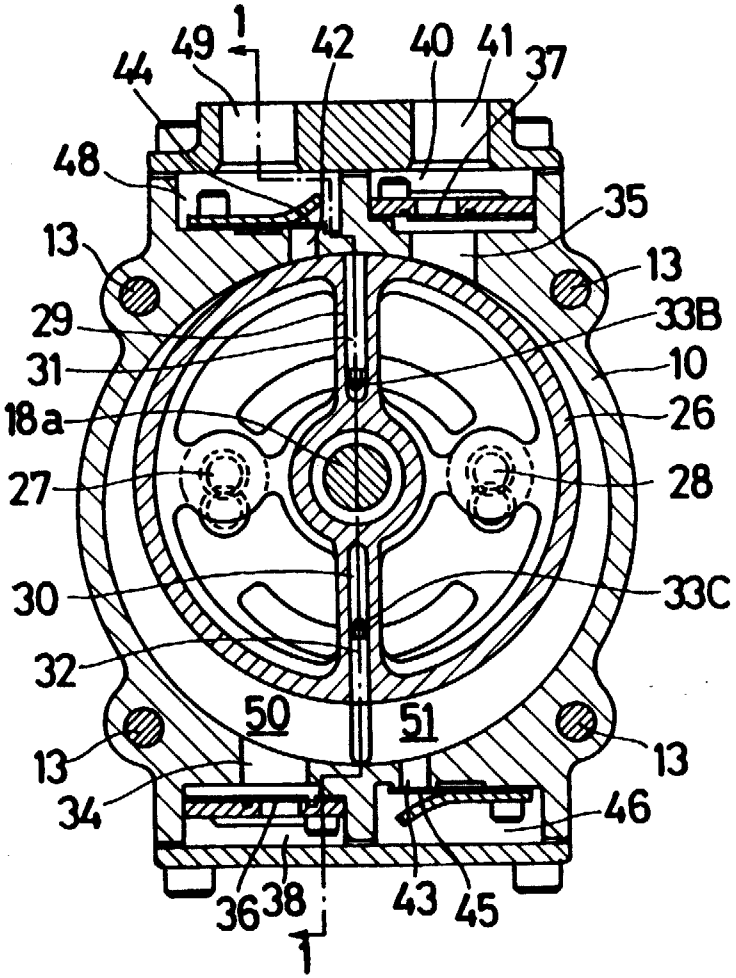
FIG. 2 is a cross-sectional view of a rotary compressor taking along line 2—2 in FIG. 1.

Referring now to FIG. 2, the rotary compressor of the first embodiment is further explained. A revolution piston 26 is installed in the cylinder 10. An eccentric portion 18a of a crank shaft 18 is inserted in the axial center of the revolution piston 26.

Figure 6:
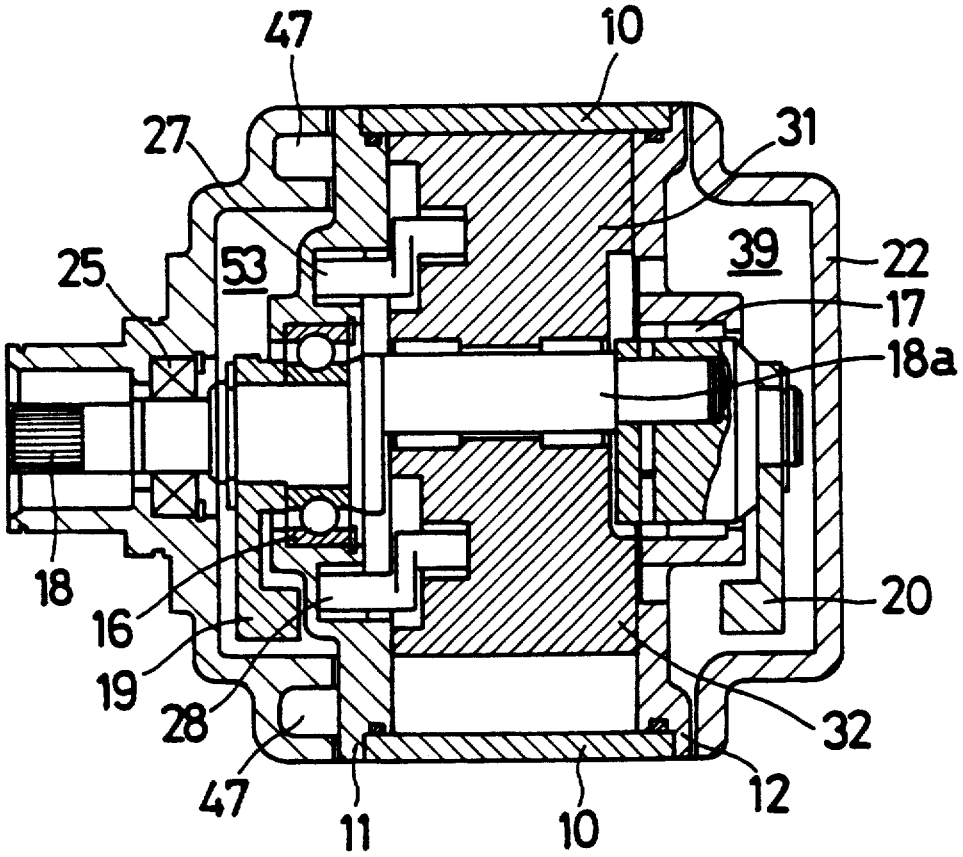
FIG. 6 is a cross-sectional view taking along line 6—6 in FIG. 3.

Further, one end of each link element 27, 28 is rotatably supported by engagement with the revolution piston 26. FIG. 6 shows how these links 27, 28 are supported. FIG. 6 is a cross-sectional view taking along line 6—6 in FIG. 3. The other end of each link 27, 28 is rotatably supported by engagement with the front end plate 11. The eccentric portion 18a of the crank shaft 18 and the links 27, 28 constitute a parallel linkage. This parallel linkage restricts movement of the revolution piston 26, and prevents the revolution piston 26 from turning round on its axis.

An eccentric length between the crank shaft 18 and the eccentric portion 18a is equal to the length of each link 27, 28. Further, the eccentric length of the crank shaft 18 and the length of each link 27, 18 are defined so as to move the sliding blades 31, 32 between suction ports 34, 35 and discharge ports 42, 43.

Two slits 29, 30 are provided in the revolution piston 26. The blades 31, 32 are slidably inserted in the slits 29, 30. As shown in FIG. 1, the blades 31, 32 are pressed in the opposite directions by a single spring 33. As can be seen in FIG. 1, the spring 33 includes a bight portion 33A disposed adjacent a longitudinal end of the piston 26. The bight portion has radially spaced ends from which two legs 33B, 33C project generally longitudinally. The legs engage respective ones of the blades 31, 32 to press the blades 31, 32 against the cylinder 10. The blades 31, 32 divide an internal space in the cylinder 10 into two chambers 50, 51.

Two suction ports 34, 35 are provided in the cylinder 10. Suction valves 36, 37 are provided at each suction port 34, 35. The suction port 34 is connected to an inlet port 41 through the suction inlet passages 38, 39, 40. The suction port 35 is also connected to the inlet port 41. Accordingly, the working medium supplied to the inlet port 41 is supplied to both suction ports 34, 35.

Further, two discharge ports 23, 43 are open in the cylinder 10. Discharge valves 44, 45 are provided at each discharge port 23, 43. The discharge port 43 is connected to an outlet port 49 through the discharge outlet passages 46, 47, 48. The discharge port 44 is also connected to the outlet port 49. Accordingly, the working medium which is discharged from the discharge ports 42, 43 to the outlet port 49.

Referring now to FIGS. 2, 3, 4 and 5, operation of the first embodiment is explained.

When the revolution piston 26 starts clockwise rotation from the position shown in FIG. 2, volume of the chamber 50 is expanded and the volume of chamber 51 is contracted. At this time, the working medium, which is filled in the suction inlet passage 38, is drawn from the suction port 34 to the chamber 50 through the suction valve 36. Further, the working medium, which is in the chamber 51 is discharged from the discharge port 43 to the discharge outlet passage 46 through the discharge valve 45.

Figure 3:
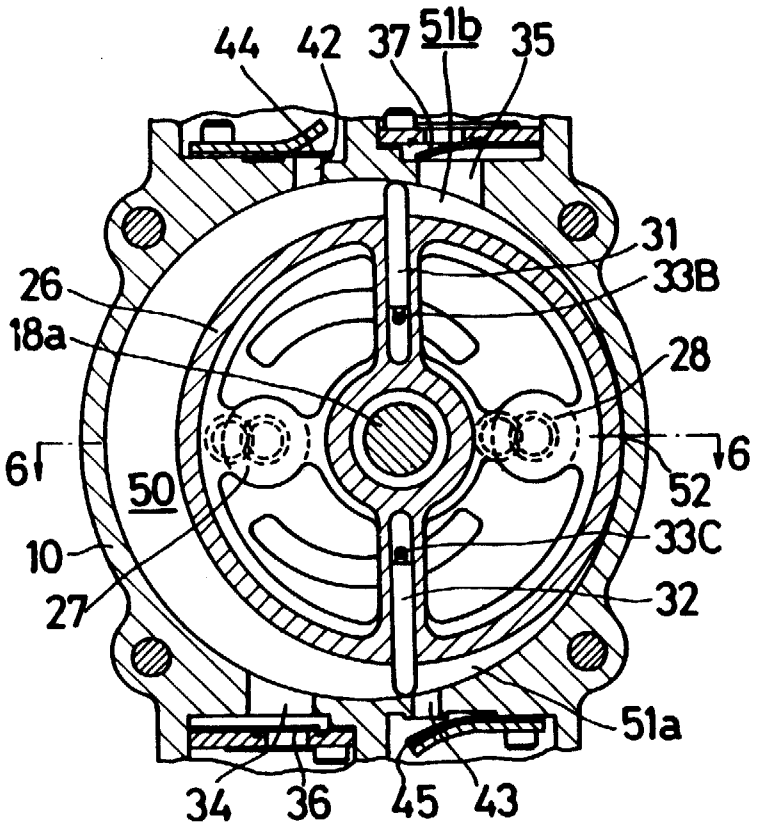
FIGS. 3, 4 and 5 are cross-sectional views of a rotary compressor taking along line 2—2 in FIG. 1 for showing operation positions of a rotary compressor.

FIG. 3 shows the other position where the revolution piston 26 rotates through 90 degrees from the position shown in FIG. 2. At this position, the volume of the chamber 50 is maximized. In this position, the working medium no longer flows through the suction port 34 nor the discharge port 42. Accordingly, both suction and discharge valves 30, 44 are closed.

Further, in the position of FIG. 3, the chamber 51 is divided into two small chambers 51a, 51b, because a line contact 52, where the revolution piston 26 contacts with the cylinder 10, exists in the chamber 51. In this position, the volume of the small chamber 51a is contracted. Therefore, the working medium is discharged from the small chamber 51a to the discharge outlet passage 46 through the discharge valve 45. At the same time, volume of the small chamber 51b is expanded. Therefore, the working medium is drawn from the inlet port 41 to the small chamber 51b through the suction valve 37.

While the revolution piston 26 rotates from the position in FIG. 1 to the position in FIG. 3, the sliding blades 31, 32 travel toward the suction port 35 and the discharge port 43. The volume of the chamber 50 is further expanded due to travel of the sliding blades 31, 32. Although the blades 31, 32 travel toward the suction and the discharge ports 35, 43, the blades 31, 32 have almost the same positions in the radial direction of the revolution piston 26. Therefore, any inertia which would affect the spring 33 from the sliding blades 31, 32 is very small, even when the revolution piston 26 rotates fast. Therefore, the sliding blades 31, 32 are capable of sustaining desirable contact with the cylinder 10.

Figure 4:
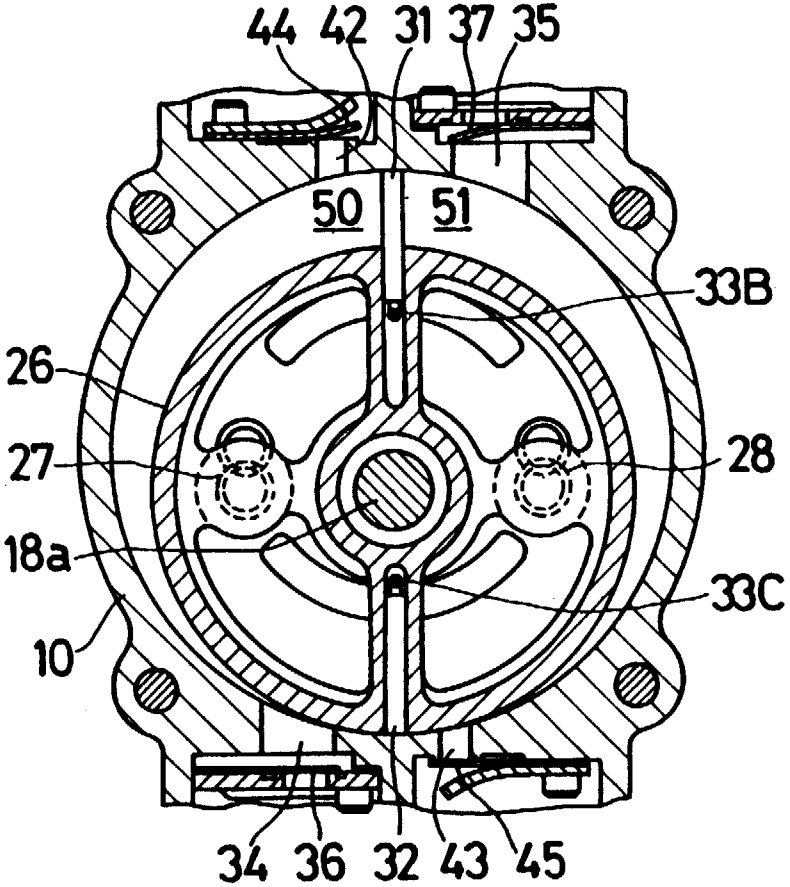

FIG. 4 shows the other position where the revolution piston 26 rotates through 90 degrees from the position shown in FIG. 3. At the position shown in FIG. 4, the volume of the chamber 50 is contracted. Therefore, the medium is discharged from the chamber 50 to the outlet port 49 through the discharge valve 44.

Further, the volume of the chamber 51 is expanded. Therefore, the working medium is drawn from suction port 35 to the chamber 51 through the suction valve 37.

While the revolution piston 26 rotates from the position in FIG. 3 to the position in FIG. 4, the sliding blades 31, 32 travel toward the suction port 34 and the discharge port 42. The volume of the chamber 50 is further contracted due to travel of the sliding blades 31, 32. Although the blades 31, 32 travel toward the suction and the discharge ports 34, 42, the blades 31, 32 have almost the same position in the radial direction of the revolution piston 26. Therefore, the inertia which affect the spring 33 from the sliding blades 31, 32 is also very small, even when the revolution piston 26 rotates fast. Therefore, the sliding blades 31, 32 ar®capable of sustaining desirable contact with the cylinder 10.

Figure 5:
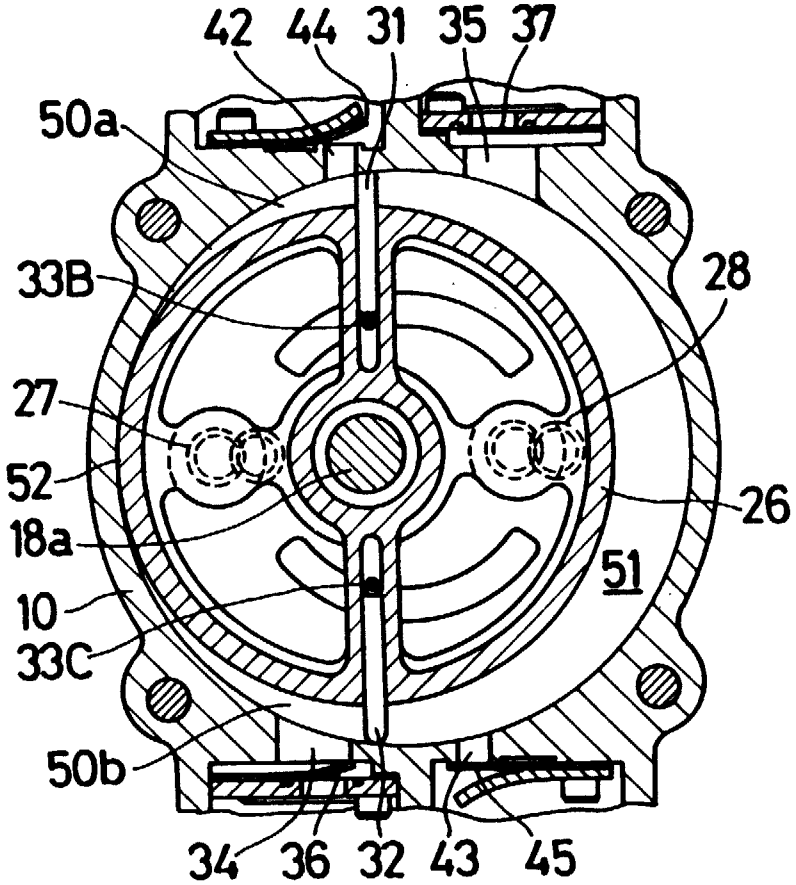

FIG. 5 shows the other position where the revolution piston 26 rotates through 90 degrees from the position shown in FIG. 4. At the position shown in FIG. 5, the chamber 50 is divided into two small chambers 50a, 50b, because of the line contact 52 in the chamber 50. At this position, volume of the small chamber 50a is contracted. Therefore, the working medium is discharged from the small chamber 50a to the outlet port 49 through the discharge valve 44. At the same time, volume of the small chamber 50b is expanded. Therefore, the working medium is drawn from the suction inlet passage 38 to the small chamber 50b through the suction valve 36.

At this position, the volume of the chamber 51 is maximized. Therefore, the working medium no longer flows through the suction port 35 nor the discharge port 43 in this position. Accordingly, both suction and discharge valves 37, 45 are closed.

While the revolution piston 26 rotates from the position in FIG. 4 to the other position in FIG. 5, the sliding blades 31, 32 travel toward the suction post 34 and the discharge port 42. The volume of the chamber 51 is further expanded due to travel of the sliding blades 31, 32. Although the blades 31, 32 travel toward the suction and the discharge ports 34, 42, the blades 31, 32 have almost the same positions in the radial direction of the revolution piston 26. Therefore, the inertia which would affect the spring 33 from the sliding blades 31, 32 is also very small, even when the revolution piston 26 rotates fast. Therefore, the sliding blades 31, 32 are capable of sustaining desirable contact with the cylinder 10.

In the first embodiment, the compressor passes above four positions repeatedly in order to draw the working medium from the inlet port 41 and to discharge the working medium from the outlet port 49.

Figure 7:
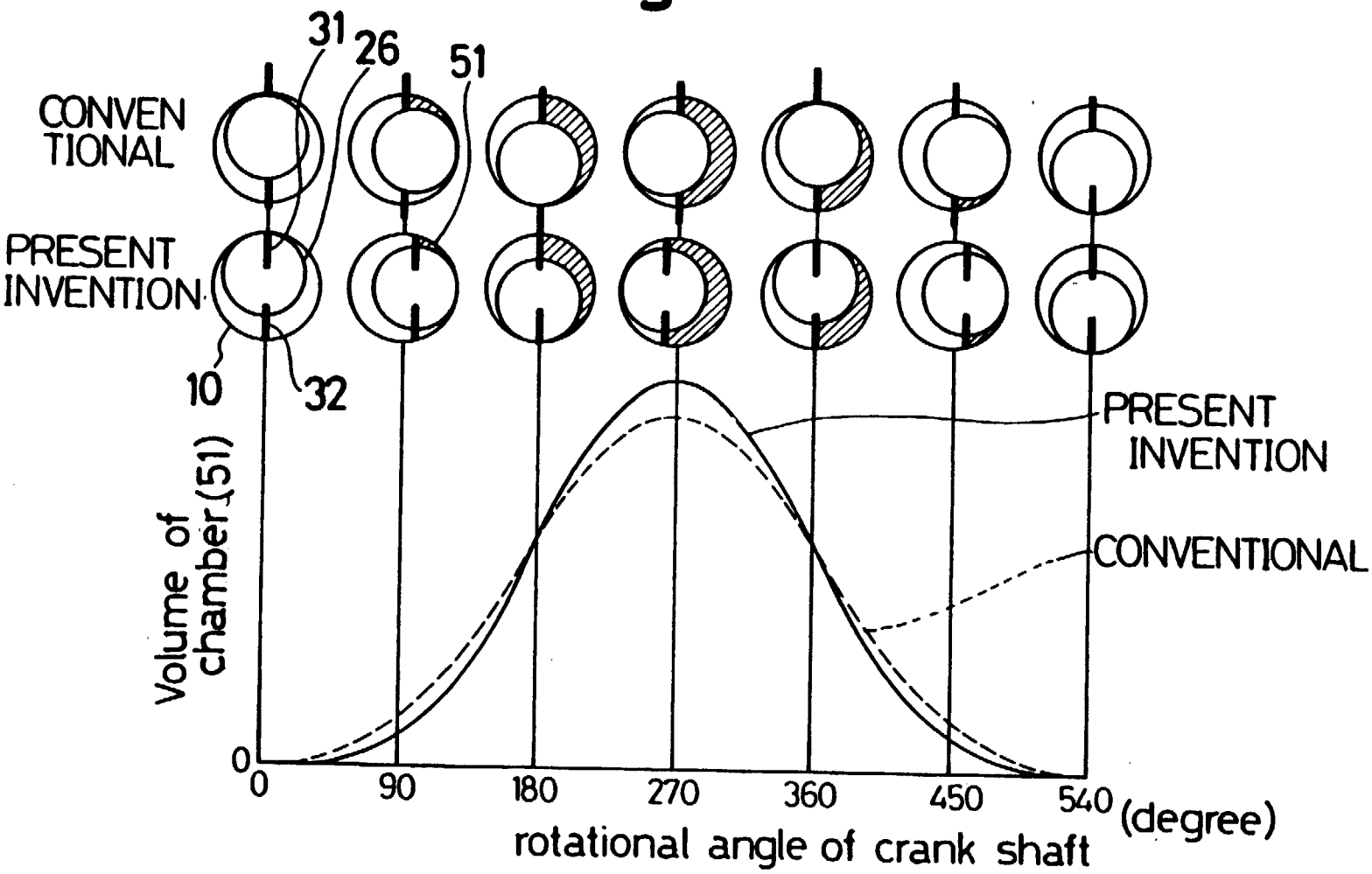
FIG. 7 is a graph showing volume comparisons of one chamber relative to rotational angle of a crank shaft.
Figure 8:
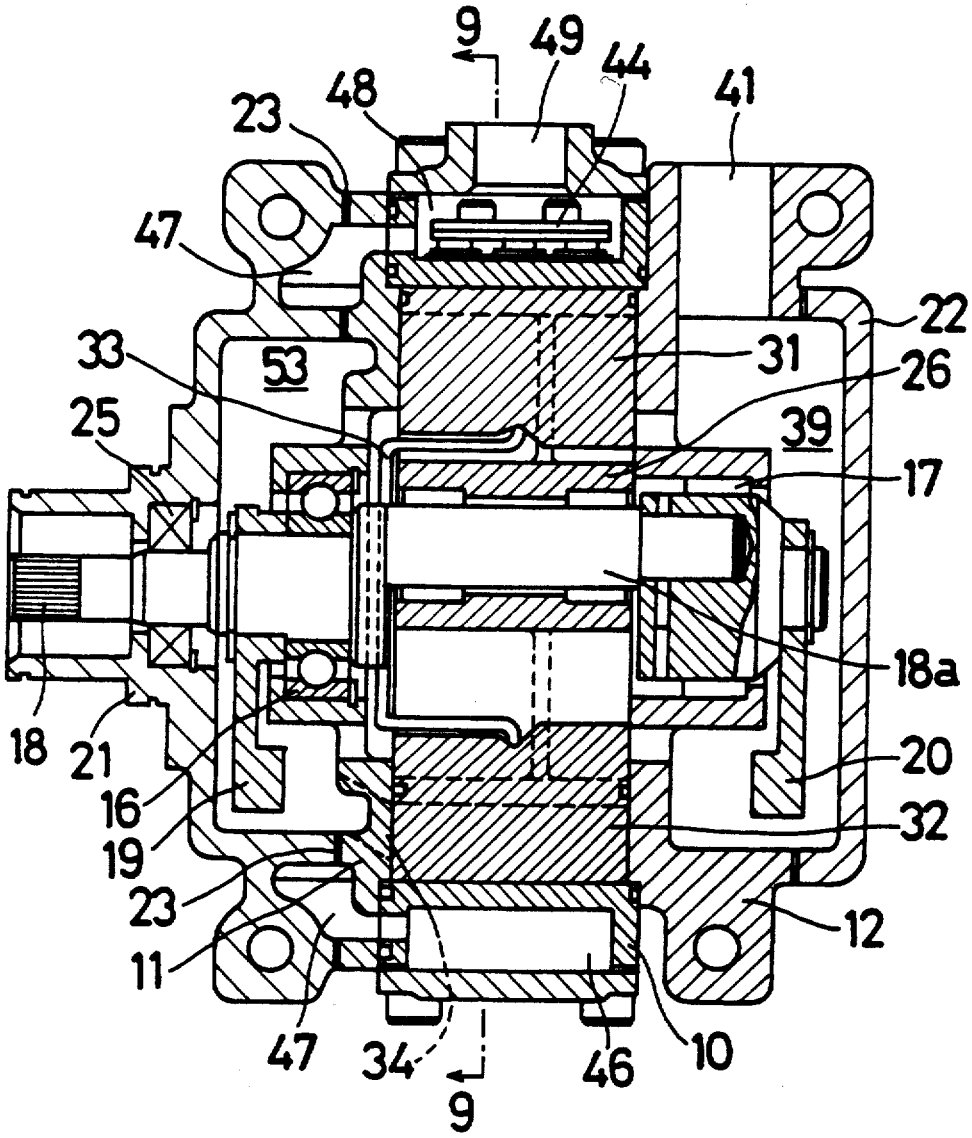
FIG. 8 is a vertical cross-sectional view of a rotary compressor taking along line 8—8 in FIG. 3.

FIG. 7 shows a relationship between the volume of the chamber 51 and rotational angle of the crank shaft 18. FIG. 7 also shows the other relationship between a volume of a chamber and rotational angle of the crank shaft in accordance with the conventional compressor having two sliding blades.

As shown in FIG. 7, the volume of the chamber 51 is maximized when the angle of the crank shaft 18 is at 270 degrees. The maximum volume of the chamber 51 is larger than the conventional chamber due to reciprocal movement (i.e., right and left movements in FIGS. 2–5) of the slidable blades 31, 32.

Further, in spite of the reciprocal movement of the slidable blades 31, 32, the blades 31, 32 have almost the same positions in the radial direction of the revolution piston 26. Therefore, inertia which would affect the spring 33 from the sliding blades 31, 32 is very small. As a consequence, the sliding blades 31, 32 press against the cylinder 10 with almost constant force which is predetermined by the spring 33, even when the rotational speed of the revolution piston 20 changes.

Meanwhile, the force of the spring 33 is determined based on a maximum pressure which is required for the compressor in the first embodiment. Therefore, the sliding blades 31, 32 may be apart from the cylinder 10 in order to relieve an excessive pressure, if the excessive pressure is generated in the chambers 50, 51. When the sliding blade is apart from the cylinder 10, the excessive pressure is relieved from the contracting chamber 50 or 51 to the expanding chamber 51 or 50. Thus, in the first embodiment, the sliding blades 31, 32 are capable of relieving the excessive pressure in the contracting chamber 50 or 51.

Referring now to FIGS. 8, 9, 10, 11 and 12, the second embodiment of this invention is explained. The second embodiment has substantially the same construction as the first embodiment. Therefore, only some differences between the first and the second embodiments are explained.

In the second embodiment, the suction valves 36, 37, which are provided on the suction ports 34, 35 in the first embodiment, are not needed due to the suction ports 34, 35 being provided on the front end plate 11. In the second embodiment, although the suction valves 36, 37 are not provided, the revolution piston 26 closes the suction ports 34, 35. Therefore, the second embodiment can operate substantially similar to the first embodiment.

Figure 9:
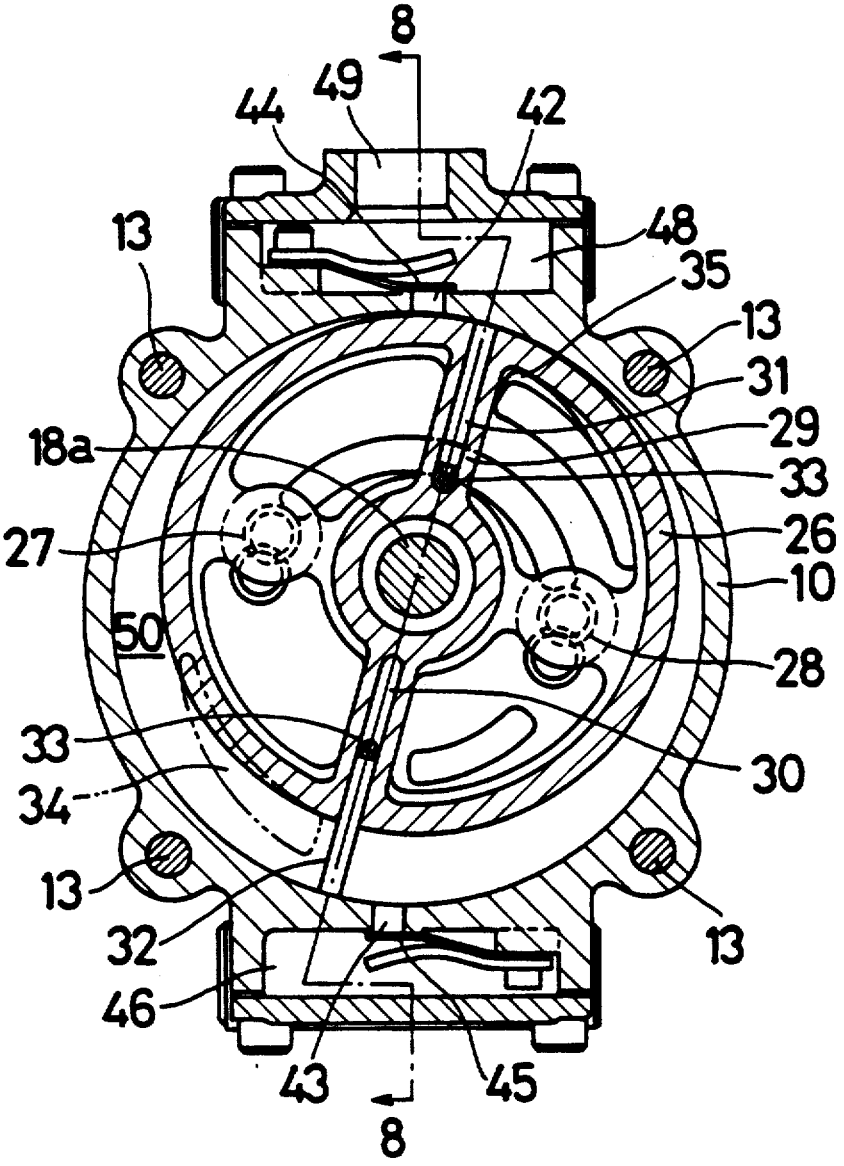
FIG. 9 is a cross-sectional view of a rotary compressor taking along line 9—9 in FIG. 1.

Referring now to FIG. 9, the second embodiment is explained.

When the revolution piston 26 starts clockwise rotation, the volume of the chamber 50 is expanded, and the volume of the chamber 51 is contracted. At this time, the working medium is drawn from the suction port 34 to the chamber 50.

Further, from this position, the suction port 35 is fully closed by the revolution piston 26, and the chamber 51 starts compressing the working medium.

Figure 10:
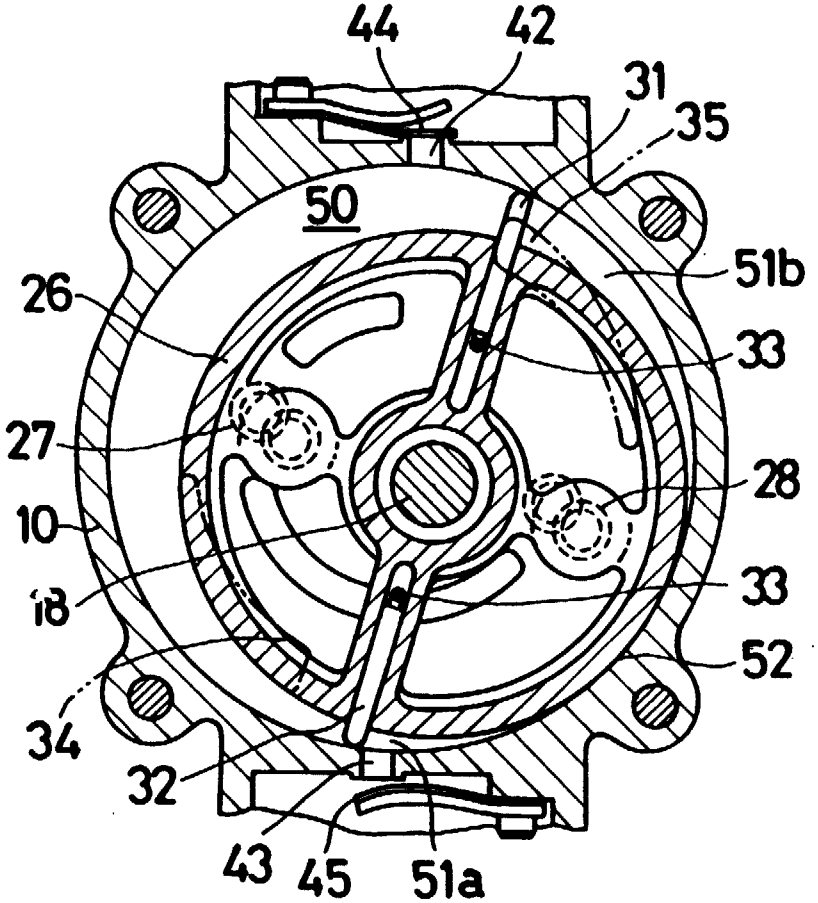

FIG. 10 shows the position where the revolution piston 26 rotates through 90 degrees from the position shown in FIG. 9. At the position shown in FIG. 10, the volume of the chamber 50 is maximized. When the volume of the chamber 50 is maximized, the suction port 34 is almost closed by the revolution piston 26.

Further, the chamber 51 is divided into two small chambers 51*a*, 51*b*, because of line contact 52 in the chamber 51. At this position, a volume of the small chamber 51*a* is contracted. Therefore, the working medium is discharged from the small chamber 51*a* to the outlet port 49 through the discharge valve 45. At the same time, the suction port 35 is opened. Therefore, the working medium is drawn from the suction port 35 to the small chamber 51*b*.

Figure 11:
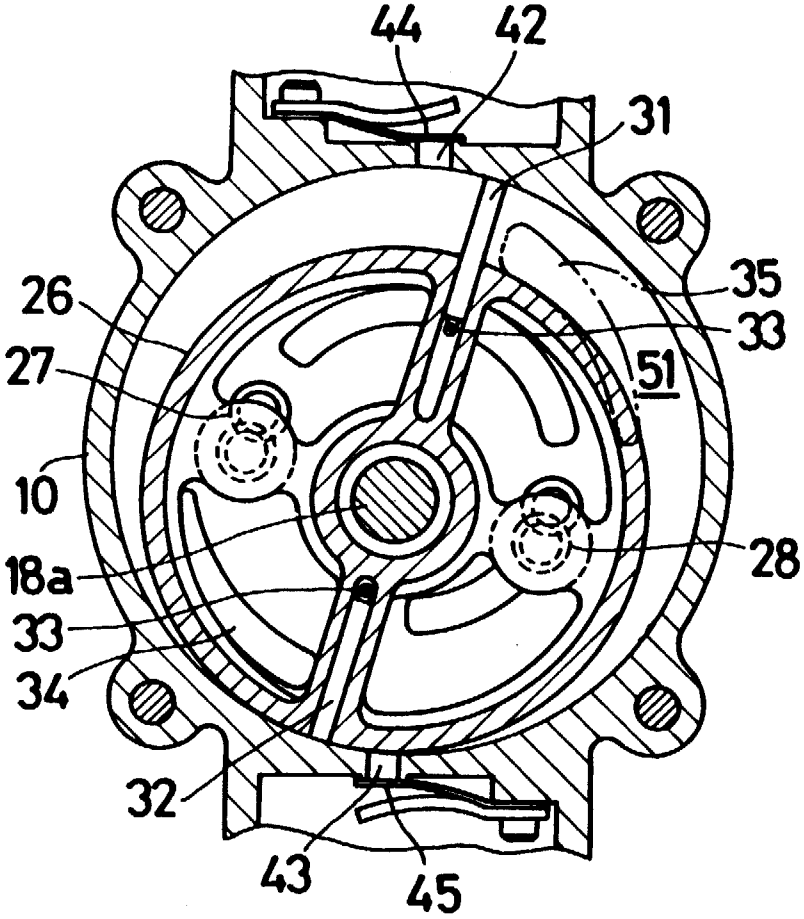
FIG. 10, 11 and 12 are cross-sectional views of a rotary compressor taking along line 9—9 in FIG. 1 for showing an operation of a rotary compressor.

FIG. 11 shows the position where the revolution piston 26 rotates through 90 degrees from the position shown in FIG. 10. From this position, the suction port 34 is fully closed by the revolution piston, and the chamber 50 starts compressing the working medium.

Further, at the position shown in FIG. 11, the volume of the chamber 51 is still expanding. Therefore, the working medium is still drawn from the suction port 35 to the chamber 51.

Figure 12:
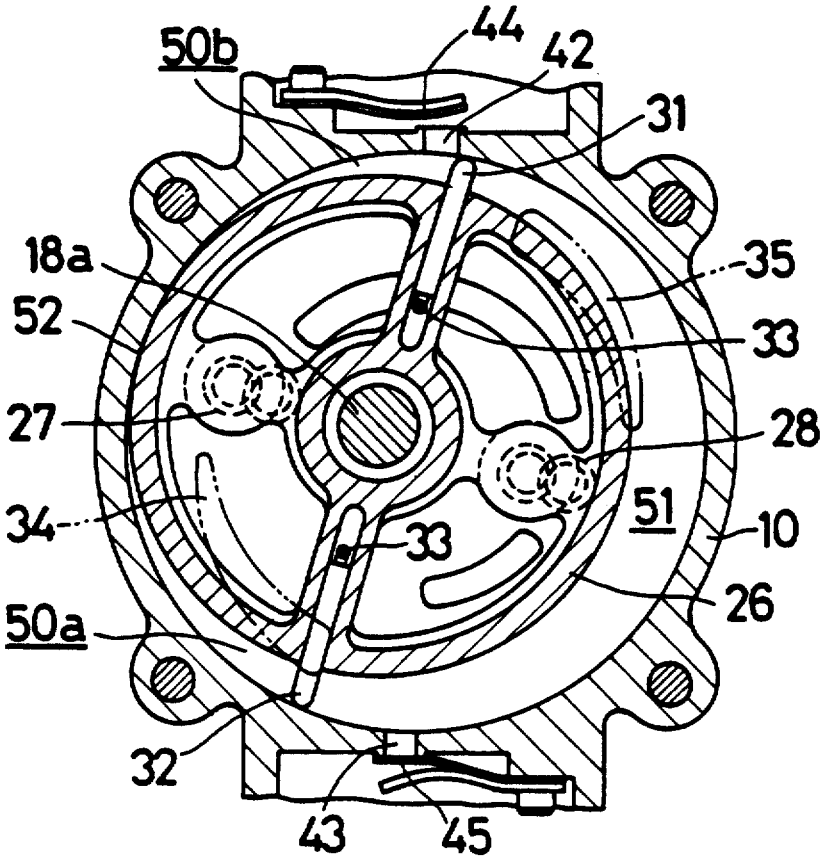
Figure 13:
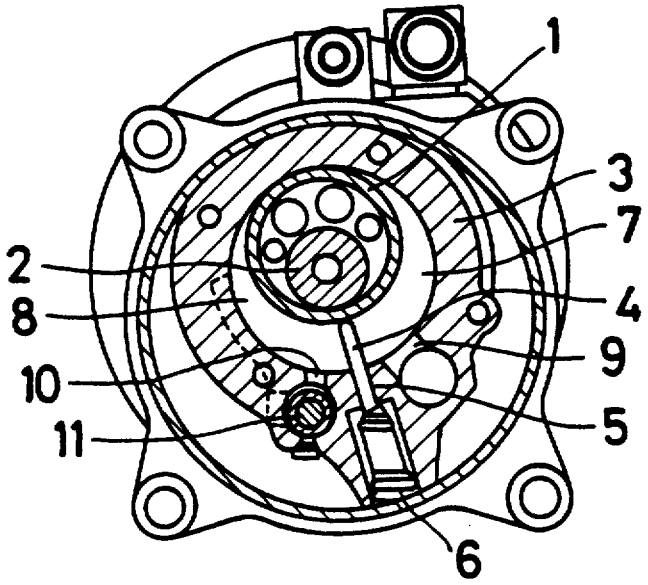
Fig. 13 PRIOR ART
FIG. 13 is a cross-sectional view showing a conventional compressor.

FIG. 12 shows the position where the revolution piston rotates through 90 degrees from the position shown in FIG. 11. The chamber 50 is divided into two small chambers 50*a*, 50*b*, due to the contact 51 in the chamber 50. At this position, the working medium is drawn from the suction port 34 to the small chamber 50*a* because the suction port 31 is opened in the small chamber 50*a*. At the same time, the working medium is discharged from the small chamber 50*b* to the outlet port 49 through the discharge valve 44.

According to the second embodiment, the suction valves 34, 35 are not needed on the suction ports 34, 35. Therefore, reliability of the device may be improved due to a reduction of the number of movable members. Further, resistance of the working medium is reduced.

In the first and the second embodiments, a single spring 33 is utilized for urging the sliding blades 31, 32. However, two or more springs may be utilized without departing the scope of the invention.

Further, in the first and the second embodiments, the inertia which effects the sliding blades 31, 32 is quite small. Therefore, the slide blades 31, 32 may not be effected by centrifugal force This also helps prevent loss of the working medium leaking through the sliding blades 31, 32.

Various modification may be made in the invention without departing from the scope or spirit of the invention.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A rotary compressor comprising a housing having inlet port means and outlet port means for conducting working medium, a cylindrical revolving piston disposed in said housing for sucking working medium through said inlet port means and expelling working medium through said outlet port means, said housing including a cylinder defining an inner space in which said piston is disposed and end plate means closing off opposite ends of said cylinder, support means for supporting said piston so as to prevent rotary movement of said piston about its axis, sliding blades disposed in said piston for dividing said inner space into at least two chambers, and pressing means for pressing said blades against an inner surface of said cylinder, said inlet port means being valveless and disposed in said end plate means to be sequentially opened and closed by said piston as said piston revolves within said inner space, said pressing means comprising a one-piece spring including a bight portion disposed adjacent a longitudinal end of said piston and having two radially spaced ends, and two legs projecting generally longitudinally from respective ones of said radially spaced ends, said legs arranged to engage respective ones of said blades to bias said blades radially outwardly.

2. The rotary compressor of in claim 1, wherein the support means includes a parallel linkage.

3. The rotary compressor claim 1, wherein the pressing means includes relief means for relieving excessive pressure.

4. The rotary compressor of claim 1, wherein said inlet port means comprises at least one port which is elongated in a direction extending circumferentially about an axis defined by said cylinder.

5. The rotary compressor of claim 1, wherein said outlet port means being valved and disposed in said cylinder.

6. The rotary compressor of claim 5, wherein said output port means comprises two outlet ports and said inlet port means comprises two inlet ports.

7. The rotary compressor of claim 6, wherein said end plate means comprises a pair of oppositely disposed end plates, both of said inlet ports disposed in one of said end plates.

8. A rotary compressor according to claim 1, wherein said sliding blades are aligned on a common diameter of said piston.

* * * * *